US007434524B2

(12) United States Patent
Sandler

(10) Patent No.: US 7,434,524 B2
(45) Date of Patent: Oct. 14, 2008

(54) MACHINE TO GET RID OF HURRICANES

(76) Inventor: Brian Peter Sandler, 5643 Putnam, West Bloomfield, MI (US) 48323

( * ) Notice: Subject to any disclaimer, the term of this patent is extended or adjusted under 35 U.S.C. 154(b) by 88 days.

(21) Appl. No.: 11/505,001

(22) Filed: Aug. 16, 2006

(65) Prior Publication Data

US 2008/0047480 A1 Feb. 28, 2008

(51) Int. Cl.
*B63B 9/06* (2006.01)

(52) U.S. Cl. ..... 114/65 R; 239/14.1

(58) Field of Classification Search ..... 239/2.1, 239/14.1; 114/65 R
See application file for complete search history.

(56) References Cited

U.S. PATENT DOCUMENTS 2,268,320 A * 12/1941 Brandt ..... 244/114 R
5,492,274 A * 2/1996 Assaf et al. ..... 239/2.1
5,971,293 A * 10/1999 Proietti ..... 239/14.1
2004/0112055 A1* 6/2004 Michaud ..... 60/641.8
2008/0035750 A1* 2/2008 Aylor ..... 239/2.1

* cited by examiner

*Primary Examiner*—Stephen Avila

(57) ABSTRACT

A machine and method of operation to get rid of hurricanes. The general idea is to get rid of the low pressure in the center of the hurricane. No low pressure equals no circulation. No circulation equals no hurricane.

The machine is a ship consisting of two main parts, an upper part and a lower part. The lower part consists of four submersible torpedo shaped hulls. The upper part is V shaped with three fan tubes stacked vertically on each side of the V.

Method of operation. The machine is placed in the hurricane eyewall near the hurricane eye. The machine would mechanically blow air from the eyewall to the eye. The machine would bend the eyewall so that the eyewall would be diverted into the eye. The machine would slow down the air in the eyewall and the low pressure in the eye would suck the air in.

1 Claim, 7 Drawing Sheets

MACHINE TO GET RID OF HURRICANES

A STATEMENT CLAIMING UTILITY

Hurricanes cause massive death and destruction to America. We need to develop machines and methods to stop them. This experimental machine and method of operation will stop hurricanes from wrecking large parts of America.

BACKGROUND OF THE INVENTION

Field of Invention

The present invention relates to controlling the weather, more particularly, getting rid of hurricanes.

BRIEF SUMMARY OF THE INVENTION

A machine and method of operation to get rid of hurricanes. The general idea is to get rid of the low pressure in the center of the hurricane. No low pressure equals no circulation. No circulation equals no hurricane.

The machine is a ship consisting of two main parts, an upper part and a lower part. The lower part consists of four submersible torpedo shaped hulls. The upper part is V shaped with three fan tubes stacked vertically on each side of the V.

Method of operation. The machine is placed in the hurricane eyewall near the hurricane (eye. The machine would mechanically blow air from the eyewall to the eye. The machine would bend the eyewall so that the eyewall would be diverted into the eye. The machine would slow down the air in the eyewall and the low pressure in the eye would suck it in.

Figure 1:
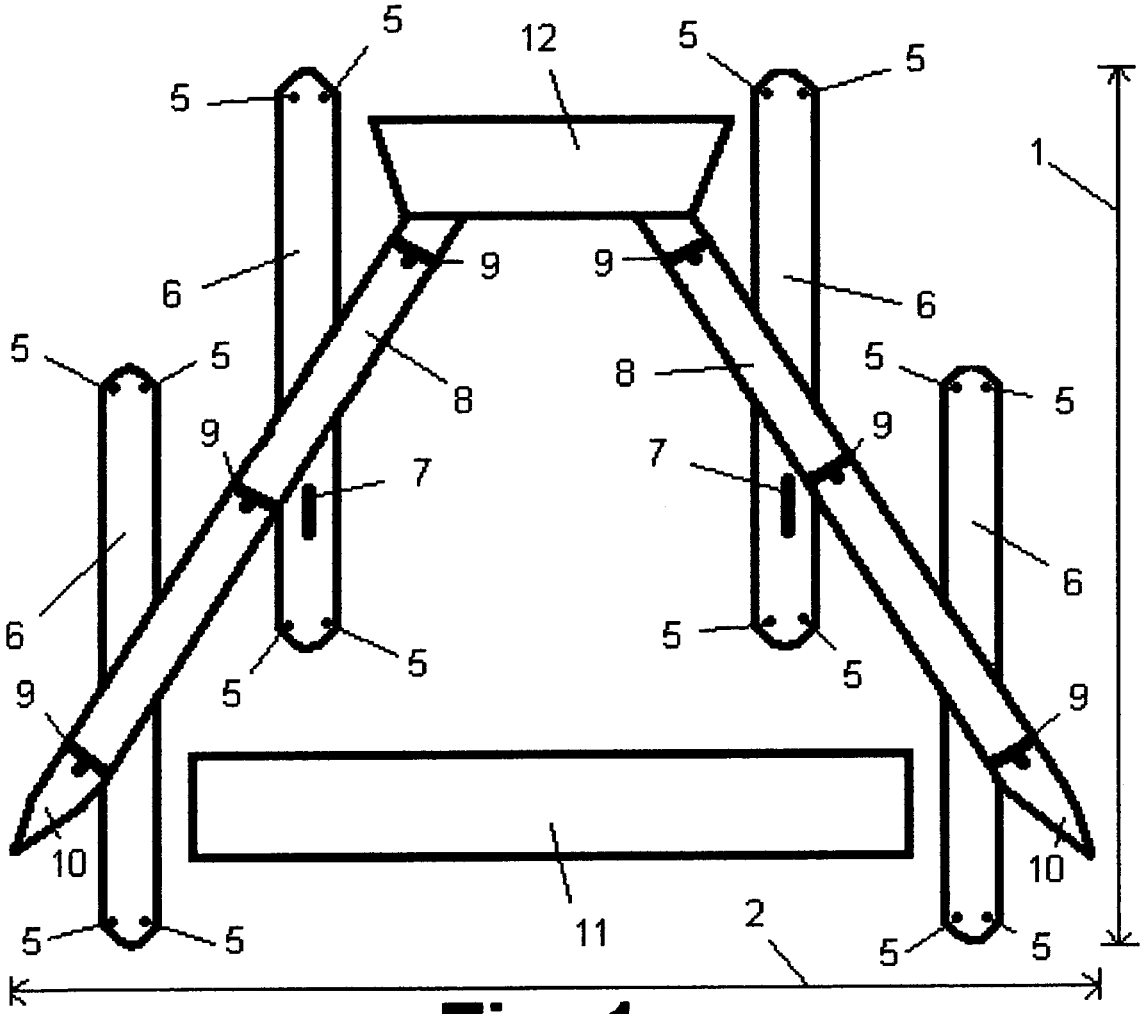
FIG. 1 is a view from the top of the machine looking down.

Number 1 is the length of the machine.—See FIG. 1

Number 2 is the width of the machine.—See FIG. 1

Figure 2:
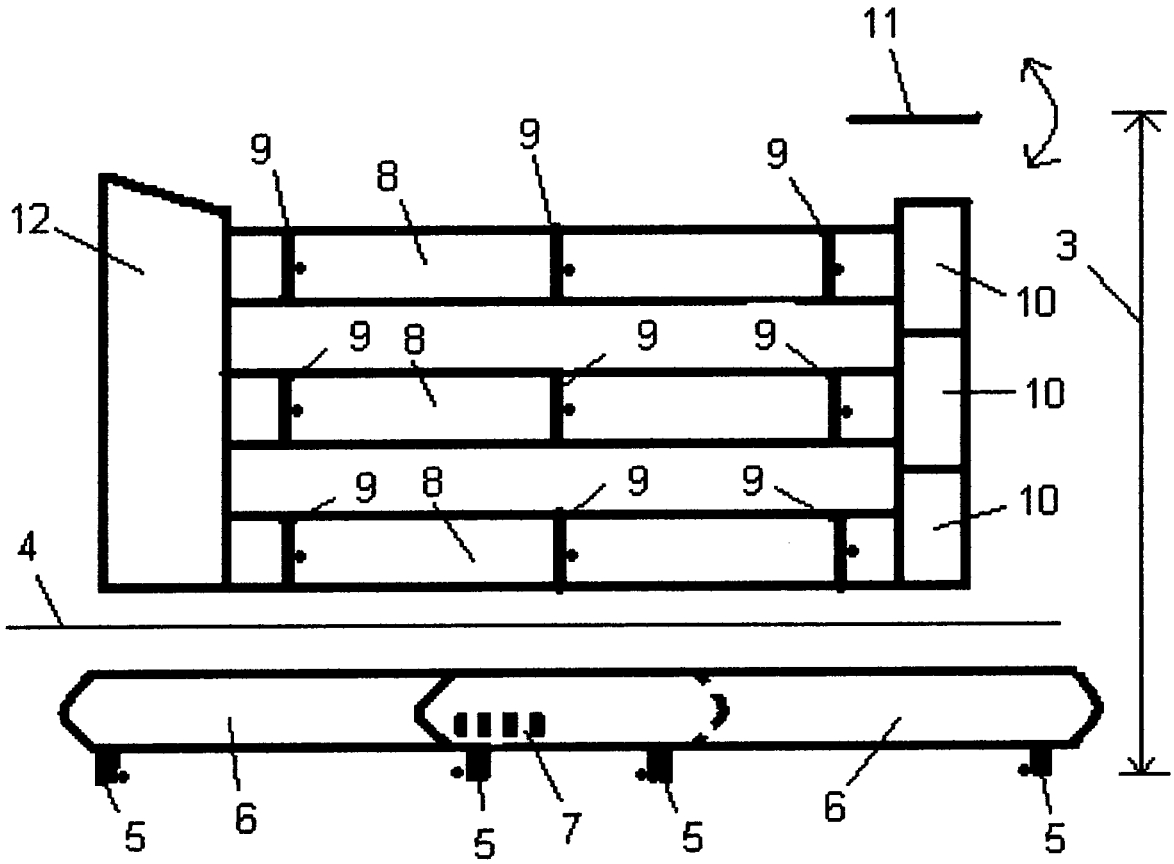
FIG. 2 is a side view of the machine.

Number 3 is the height of the machine.—See FIG. 2

Number 4 is a line indicating the top of the waves.—See FIG. 2

Figure 3:
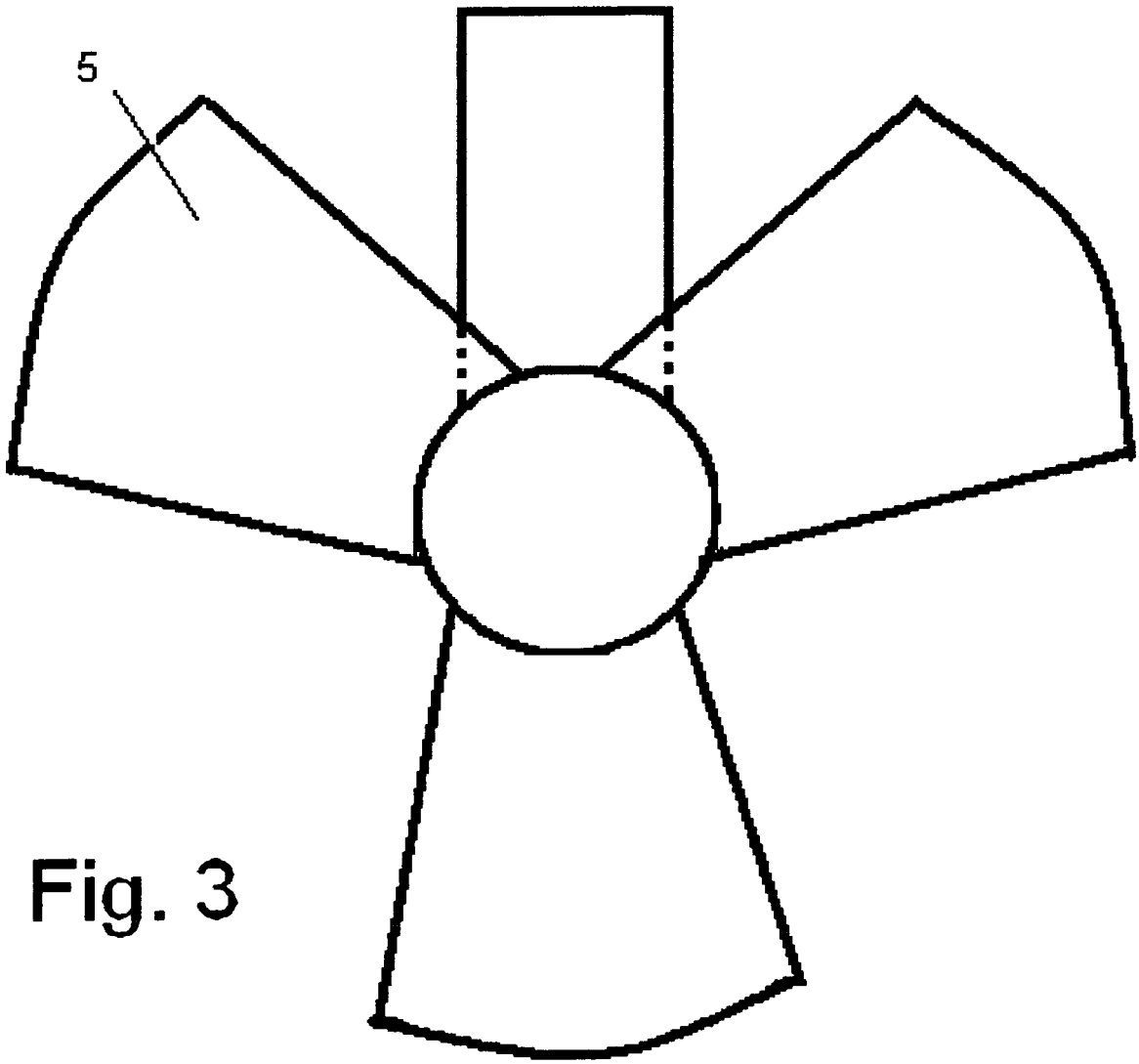
FIG. 3 is an electric powered rotating thruster.

Number 5s are electric powered rotating thrusters.—See FIG. 1, FIG. 2, and FIG. 3

Number 6s are submersible hulls—See FIG. 1 and FIG. 2

Number 7s are diesel-powered generators.—See FIG. 1 and FIG. 2

Number 8s are fan tubes.—See FIG. 1 and FIG. 2

Figure 4:
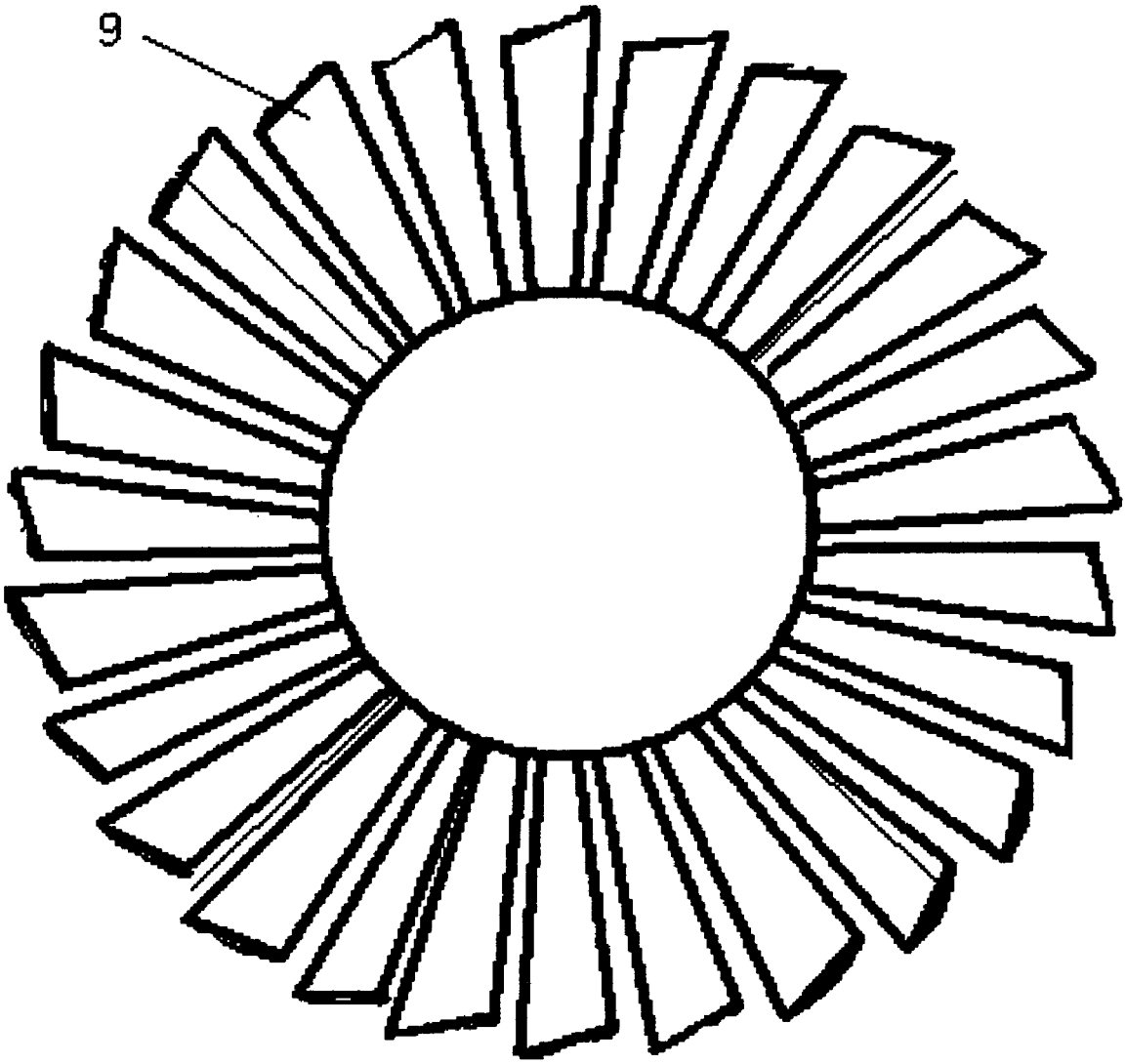
FIG. 4 is a high-speed fan and electric motor.

Numbers 9s are high-speed fans with electric motors.—See FIG. 1, FIG. 2, and FIG. 4

Numbers 10s are adjustable nozzles.—See FIG. 1 and FIG. 2

Number 11 is the rear wing.—See FIGS. 1, 2, 5, 6, 7

Number 12 is the air intake.—See FIG. 1 and FIG. 2

Figure 5:
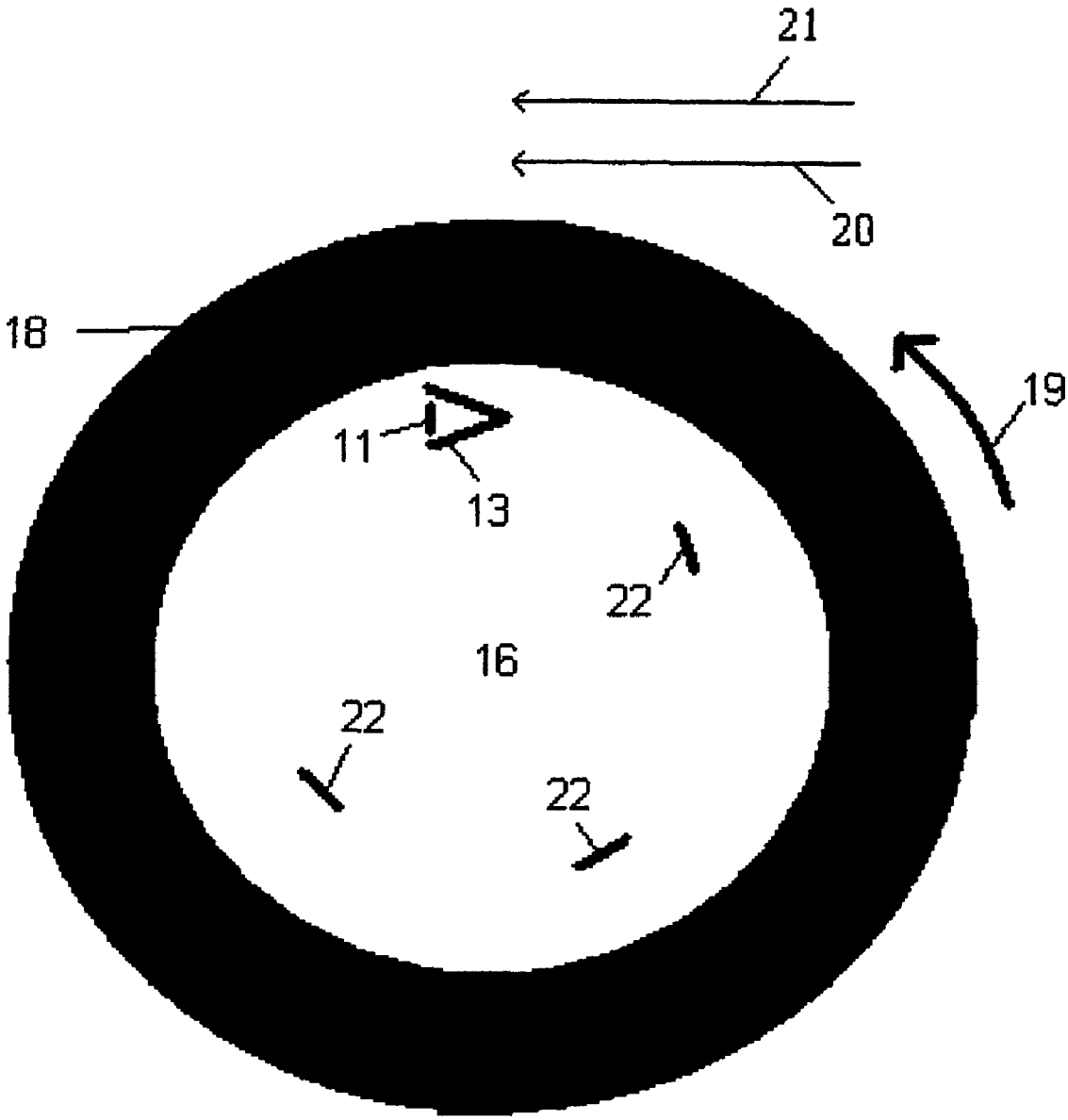
FIG. 5 is the machine getting ready to enter the hurricane eyewall.
Figure 6:
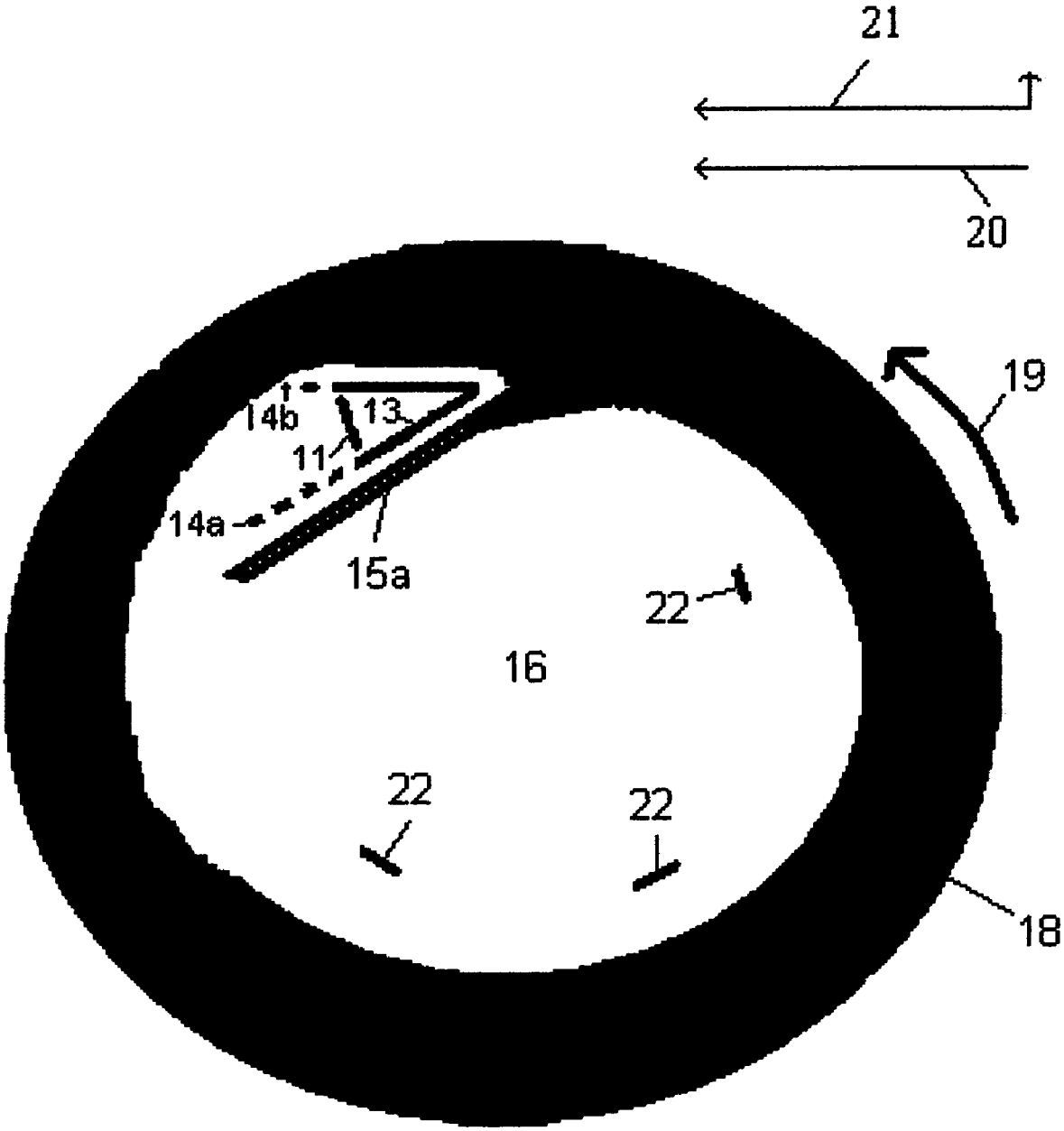
FIG. 6 is the machine entering the hurricane eyewall.
Figure 7:
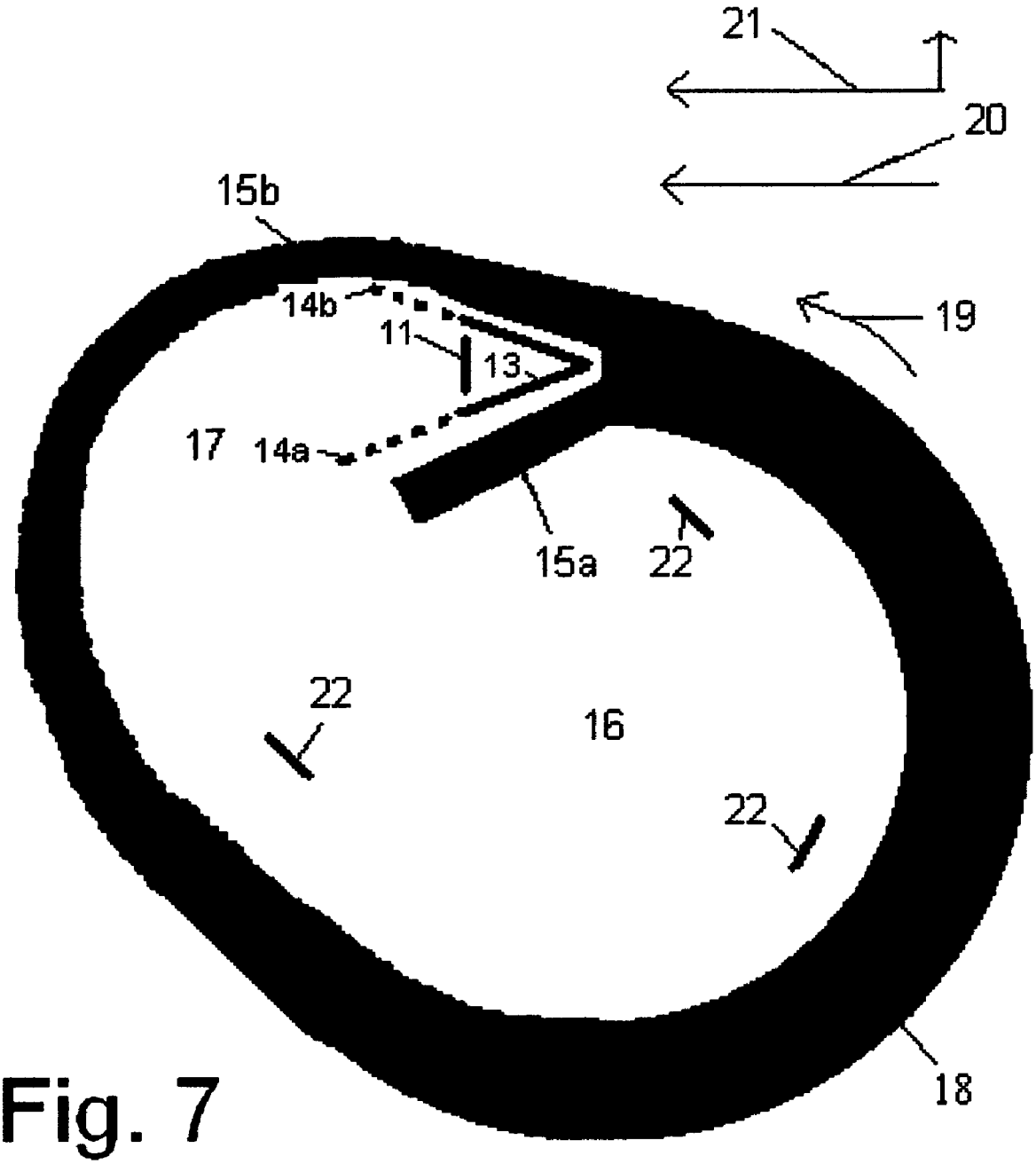
FIG. 7 is the machine moving farther into the hurricane eyewall.

Number 13 is the ship—See FIGS. 5, 6 and 7

Number 14*a* and 14*b* are the air coming out of the fan tubes.—See FIGS. 6 and 7.

Number 15*a* and 15*b* show the hurricane eyewall being diverted.—See FIGS. 6 and 7.

Number 16 is the center of the hurricane eye.—See FIGS. 5, 6 and 7.

Number 17 shows the hurricane eye getting bigger.—See FIG. 7

Number 18 is the hurricane eyewall.—See FIGS. 5, 6 and 7.

Number 19 is an arrow indicating wind direction.—See FIGS. 5, 6 and 7.

Number 20 is an arrow indicating movement of the hurricane.—See FIGS. 5, 6 and 7.

Number 21 is an arrow indicating movement of the ship—See FIGS. 5, 6 and 7.

Number 22s are atmosphere-testing equipment—See FIGS. 5, 6 and 7

DETAILED DESCRIPTION OF THE INVENTION

A machine and method of operation to get rid of hurricanes.

The machine is a ship; the length of the machine is approximately 640 meters/2100 feet.—See number 1 in FIG. 1.

The width of the machine is approximately 609 meters/2000 feet.—See number 2 in FIG. 1

The height of the machine is approximately 289 meters/950 feet.—See number 3 in FIG. 2

The front of the machine is the air intake.—See number 12 in FIGS. 1 and 2

The back of the machine are the nozzles.—See number 10s in FIGS. 1 and 2

The top of the machine is the rear wing.—See number 11 in FIGS. 1 and 2

The bottom of the machine are the rotating thrusters.—See number 5s in FIGS. 1 and 2

Number 5s are electric powered rotating thrusters. See FIGS. 1, 2, and 3. The thrusters rotate 360 degrees.

Numbers 6s are submersible hulls. See FIGS. 1 and 2. There are four hulls. The hulls are approximately 396 meters/1300 feet long. The hulls operate below the big waves and provide a stable platform for the upper part of the machine.

Numbers 7s are diesel-powered generators. See FIGS. 1 and 2. The generators provide electric power to the rotating thrusters (number 5s) and the high-speed fans (number 9s)

Number 8s are the fan tubes. See FIGS. 1 and 2 the fan tubes are approximately 457 meters/1500 feet long, the diameter of the fan tubes is approximately 30 meters/100 feet. The fan tubes are attached to the air intake (number 12) in the front and the nozzles (number 10s) in the back. There are six fan tubes; three stacked vertically on each side of the V shaped upper part of the machine. Each fan tube contains three high-speed fans with electric motors (number 9s.)

Numbers 9s are high-speed fans with electric motors. See FIG. 1,2, and 4. The diameter of the fans is approximately 30 meters/100 feet. There are three fans in each of the six fan tubes (number 8s) The fans are made out of light-weigh, high-strength, carbon-fiber material. The fans accelerate the air in the fan tubes to approximately 1930 Kilometers/hour/1200 miles/hour. The fans are similar in design to the fans in jet engines.

Numbers 10s are adjustable nozzles. See FIGS. 1 and 2. There are six nozzles; each nozzle connects to a fan tube. The nozzles are adjustable, they pivot left to right, they also open and close to control both direction and speed of the air exiting the fan tubes.

Number 11 is the rear wing. See FIGS. 1 and 2. The rear wing is approximately 487 meters/1600 feet wide and 61 meters/200 feet depth. The wing pivots up and down.

Number 12 is the air intake. See FIGS. 1 and 2. The air intake is approximately 182 meters/600 feet wide and 198 meters/650 feet high. The air intake is connected to all six fan tubes.

Method of Operation

The general idea is to get rid of the low pressure in the center of the hurricane. No low pressure equals no circulation. No circulation equals no hurricane.

The air in the hurricane eyewall will not turn unless there is low pressure in the hurricane eye.

The ship is placed in the hurricane eyewall near the hurricane eye.

The ship would cause the air pressure in the hurricane eye to go up by redistributing the air in the hurricane eyewall to the hurricane eye. The ship would redistribute the air in the hurricane eyewall in three primary ways. First, the ship would mechanically blow air from the hurricane eyewall to the hurricane eye. Second, the ship would bend the hurricane eyewall so that the hurricane eyewall would be diverted into the hurricane eye, using the hurricanes own force to kill it. Third, the ship would slow down the air in the hurricane eyewall allowing the low pressure in the hurricane eye to suck in the hurricane eyewall, again using the hurricanes own force to kill it.

As the air from the hurricane eyewall enters the low pressure in the hurricane eye it expands and slows down, becoming part of the hurricane eye, raising the air pressure in the hurricane eye. As the air pressure in the hurricane eye goes up the air in the hurricane eye wall turns less. A draft is established as the hurricane eyewall goes into the hurricane eye. When the warm wet air gets into the low pressure in the hurricane eye it expands both vertically and horizontally, convection occurs in the hurricane eye, a strong up-draft in the hurricane eye is established, sucking in more of the hurricane eyewall. The system becomes more and more disorganized causing the hurricane eye and the hurricane eyewall to mix, further causing the pressure in the hurricane eye to increase. At some point the air pressure in the hurricane eye would be high enough to end circulation. The only thing left would be a big thunderstorm out in the middle of the ocean. If the hurricane re-forms, hit it again. Stay with the storm until it gets to land.

Step 1. The hulls should be submerged, and the fans turned on.—Note, the hulls operate below the big waves providing a stable base for the upper part of the ship. The high-speed fans act like gyros, they want to stay in there plane, if the ship was moving around in the big waves it would put stress on the fans possible causing them to break.

Step 2. Using the thrusters, with the fans on and the front of the ship facing the wind, sail the ship into the hurricane eye.—Note, any time the ship is in hurricane force winds the fans should be on and the front of the ship should face the wind. The sucking action of the air intake pulls the front of the ship into the big wind, like a sea anchor pulls the front of a boat into the big wind.

Step 3. After the ship gets into the hurricane eye, turn the fans off. Use the thrusters to move the ship whilst the ship is in the hurricane eye.

Step 4 Deploy atmosphere testing equipment in the hurricane eye Number 22s, see FIGS. 5, 6 and 7

Step 5. Using the thrusters move the ship to the outer part of the hurricane eye near the strongest winds. The ship should keep pace with the hurricane, moving at the same speed and direction as the hurricane. See FIG. 5

Step 6 turn the fans on, angle the rear wing down.

Step 7 using the thrusters and fans, move the ship into the hurricane eyewall. Just outside of the hurricane eye, (FIG. 6) hold the ship in that position until the hurricane eye begins to become deformed. The air coming out of the nozzles (14*a*, 14*b*) will make a wall diverting the hurricanes eyewall into and away from the hurricane eye. (15*a*,15*b* in FIG. 7) The air coming out of the nozzle(14*a*) will go into the hurricane eye. The rear wing(11) will force the eyewall down into the extreme low pressure created when the eyewall is diverted. When the air from the eyewall goes into the low pressure in the eye it will expand and slow down, it will become part of the eye.

Step 8 as the hurricane eye gets bigger, move the ship farther into the hurricane eyewall. A draft will be established into the hurricane eye and the hurricane will implode.

I claim:

1. A machine/ship to get rid of hurricanes, comprising:

a) a ship, the length of the ship is approximately 640 meters/2100 feet (1)

b) the width of the ship is approximately 609 meters/2000 feet (2)

c) the height of the ship is approximately 289 meters/950 feet (3)

d) the ship has 16 electric powered rotating thrusters (5)

e) the ship has four submersible hulls, (6) the length of the hulls is approximately 396 meters/1300 feet f) the ship has diesel-powered generators (7)

g) the ship has six fan tubes, (8) the length of the fan tubes is approximately 457 meters/1500 feet, the diameter of the fan tubes is approximately 30 meters/100 feet h) the ship has twelve high-speed fans with electric motors, (9) the diameter of the high-speed fans is approximately 30 meters/100 feet, the high-speed fans are made out of light-weigh, high-strength, carbon-fiber material, the high-speed fans are similar in design to the fans in jet engines i) the ship has six adjustable nozzles, (10) the adjustable nozzles pivot left to right, and open and close j) the ship has a rear wing, (11) the rear wing is approximately 487 meters/1600 feet wide and 61 meters/200 feet depth, the rear wing pivots up and down k) the ship has a air intake, (12) the air intake is approximately 182 meters/600 feet wide and 198 meters/650 feet high l) the ship has atmosphere-testing equipment, (22).

* * * * *